US007254245B2

(12) United States Patent
Arndt et al.

(10) Patent No.: US 7,254,245 B2
(45) Date of Patent: Aug. 7, 2007

(54) CIRCUIT AND METHOD FOR ADAPTATION OF HEARING DEVICE MICROPHONES

(75) Inventors: Georg-Erwin Arndt, Obermichelbach (DE); Joachim Eggers, Erlangen (DE); Thomas Hanses, Erlangen (DE); Torsten Niederdränk, Erlangen (DE); Hartmut Ritter, Neunkirchen am Brand (DE); Gunter Sauer, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 574 days.

(21) Appl. No.: 10/798,179

(22) Filed: Mar. 11, 2004

(65) Prior Publication Data

US 2004/0228495 A1 Nov. 18, 2004

(30) Foreign Application Priority Data

Mar. 11, 2003 (DE) ..... 103 10 580

(51) Int. Cl.
*H04R 25/00* (2006.01)

(52) U.S. Cl. ..... 381/312; 381/95; 381/318; 381/320

(58) Field of Classification Search ..... 381/312, 381/313, 316–318, 320, 321, 94.2, 111, 95, 381/97

See application file for complete search history.

(56) References Cited

U.S. PATENT DOCUMENTS

| | | | |
|---|---|---|---|
| 5,402,496 | A | 3/1995 | Soli et al. |
| 5,550,923 | A | 8/1996 | Hotvet |
| 6,272,229 | B1 | 8/2001 | Backgaard |
| 6,421,448 | B1 | 7/2002 | Arndt et al. |
| 6,424,721 | B1 | 7/2002 | Hohn |
| 6,539,096 | B1 | 3/2003 | Sigwanz et al. |

FOREIGN PATENT DOCUMENTS

| | | |
|---|---|---|
| DE | PS 199 27 278 | 12/2000 |
| DE | PS 198 49 739 | 5/2001 |
| DE | OS 199 55 156 | 6/2001 |
| EP | 0 982 971 | 3/2000 |
| EP | 1 191 817 | 3/2002 |

*Primary Examiner*—Curtis Kunz
*Assistant Examiner*—Tuan Duc Nguyen
(74) *Attorney, Agent, or Firm*—Schiff Hardin LLP

(57) ABSTRACT

The microphones used in hearing devices normally possess different characteristic lines that are to be adapted to one another. For this purpose, the amplitude of an output signal of a first microphone and the amplitude of an output signal of a second microphone are measured. The output signal of the first microphone is subsequently filtered dependent on both measured amplitudes, such that the difference between the two output signals is reduced. One of the two microphones hereby serves as a reference, and an absolute normalization can be foregone.

8 Claims, 3 Drawing Sheets

CIRCUIT AND METHOD FOR ADAPTATION OF HEARING DEVICE MICROPHONES

BACKGROUND OF THE INVENTION

1. Field of the Invention

The present invention concerns a method for reciprocal adaptation of a number of microphones of a hearing device. The present invention also concerns a corresponding circuit to adapt the microphones.

2. Description of the Prior Art

Hearing impaired persons frequently suffer a reduced communication capability in the presence interfering noise. To improve the signal-to-noise ratio, directional microphone arrangements have been used for some time, the benefit of which is indisputable for hearing impaired persons. Frequently, either systems of the first order (meaning with two microphones) or of a higher order are used. The exclusion of noise signals received from behind the person, as well as focusing on frontally incident sounds, enables a better comprehension in everyday situations.

Directional microphones, however, are sensitive with regard to detunings of the transfer functions of the microphones according to magnitude and phase. The sensitivity to detuning increases with the order of the directional microphone system and with decreasing frequency. Such directional microphone systems are most sensitive to detuning at low frequencies.

In this context, European Application 0982971 discloses that a microphone can be described or characterized at low frequencies as a high-pass filter of the first order. As shown in FIG. 1 herein, a first microphone 1 can be characterized as a high-pass filter with the transfer function a/s-pol_ac1. The microphone 1 acquires a first input signal 2. This input signal 2, filtered with the high-pass filter effect of the microphone 1, is transduced into a first microphone output signal 4 with of a first compensation filter 3. The compensation filter 3 has the transfer function s-pol_ac1/s-pol_ideal. Both numerator and denominator can be represented as polynomials. The numerator polynomial of the compensation filter 3 is selected such that it corresponds to the denominator polynomial of the acoustic high-pass filter characteristic of the microphone 1. The denominator polynomial of the compensation filter 3 corresponds to the denominator polynomial of the high-pass filter characteristic of an ideal microphone. By multiplying both transfer functions of the high-pass filter characteristic (that characterizes the real microphone 1) and of the compensation filter 3, a normalization results with regard to the ideal microphone and the specific transfer function of the first microphone is compensated.

For hearing device microphones, in a simplified approach, in particular the acoustic high-pass effect at the lower edge of the usable frequency band must be examined with regard to detunings. Contaminations, aging or modified environmental influences particularly strongly affect this region of the high-pass effect and thus modify the amplitude and frequency response of the microphone in the particularly critical middle and lower frequency ranges. A possibility to reduce such detunings is to enforce the same high-pass cut-off frequency in all microphone paths.

In the same manner, the specific high-pass effect is compensated with the transfer function s/s-pol_ac2 of the second microphone 5 with a second compensation filter 6 having the transfer function s-pol_ac2/s-pol_ideal, such that a corresponding second microphone output signal 8 arises from the second microphone input signal 7. Here the denominator polynomial of the high-pass filter 5 is also eliminated via the numerator polynomial of the second compensation filter 6. With both of these compensation filters 3 and 6, the variations of the high-pass frequency from microphone-to-microphone (that in particular would lead to phase and amplitude errors at low frequencies) can be compensated, by setting the same cut-off frequencies in all microphone paths.

A method for relative, adaptive phase compensation by two microphones is generally designed in U.S. Pat. No. 6,272,229. A general block diagram for an adaptive system is thereby specified. The system has a block "acoustical delay compensation" that, in a type of pre-processing, compensates the linear phase difference of the microphone that is a consequence of the signal delay between the microphones. No adaptation rule, however, is specified.

Further internal circuitry act primarily on the input sensitivity difference of the microphones. Conclusions or inferences about the input sensitivity of the microphones can be drawn via a temporally averaged consideration of the input level at the microphones. Assuming that the incoming audio signals are received time-delayed but with approximately the same level by all microphones, the amplitude of the input sensitivities can be compensated by a compensation of the averaged input level at the microphones.

SUMMARY OF THE INVENTION

An object of the present invention is to simplify the compensation of microphone differences in hearing devices.

This object is inventively achieved by a method for reciprocal adaptation of a number of microphones of a hearing device, by measurement of a first amplitude of a first output signal by a first of the microphones at a predetermined frequency range, measurement of a second amplitude of a second output signal by a second of the microphones in the predetermined frequency range, and by filtering the first output signal dependent on the first amplitude and the second amplitude, such that the difference between the two output signals is reduced.

The above object also is achieved in accordance with the invention by a device for reciprocal adaptation of a number of microphones of a hearing device, having a first measurement device to measure a first amplitude of a first output signal by a first of the microphones at a predetermined frequency range; a second measurement device to measure a second amplitude of a second output signal by a second of the microphones in the predetermined frequency range; and a filtering device, connected to the first and second measurement devices, to filter the first output signal dependent on the first amplitude and the second amplitude, such that the difference between the two output signals can be reduced.

Compared to the prior art according to FIG. 1, the invention foregoes a compensation filter in one microphone path, which is used as a reference path. A compensation filter is present in each microphone path, excluding the reference path. This means that, for example, a compensation filter is provided in two microphone paths given three microphones, while the third microphone path is used as a reference path.

The predetermined frequency range for the measurement of the amplitudes of both output signals of the microphones preferably corresponds to a frequency band below 150 Hz. In particular, this frequency band lies between 40 and 60 Hz or 80 to 120 Hz. This is the range in which differences in the cut-off frequency of the high-pass filter of the microphones are particularly strongly noticeable.

The filtering can be adapted with a regulation loop, such that the first and second amplitudes correspond to one another. It is thereby possible to effectively counter the temporal change of the transfer function of the microphones, for example due to contaminations.

The compensation filter can be split into two sub-filterings. A first sub-filtering is realized by a denominator polynomial that models the high-pass cut-off frequency of the reference path. A second sub-filter is realized by a numerator polynomial that is adapted such that the averaged level difference between the microphone paths is minimal. The adaptation ensues by magnitude formation of the signals, with a phase dependency not entering into the adaption. A unit such as the "acoustical delay compensation"-block cited above can thereby be omitted.

The coefficients of the numerator polynomial preferably are dependent only on a single parameter. This leads to less effort in the adaptation. If only the numerator polynomial is adaptable, this does not in principle lead to identically equivalent microphone signals, since an error can exist between the characteristic of the reference microphone and the filter effect described in the denominator polynomial. The effect of this good approximation solution, however is sufficient to clearly improve the directional effect with minimal effort.

An optimal adaptation of the two or more microphones to one another is possible when the denominator polynomial is also variable. This additional adaptation possibility also ensures a faster adaptation via the control circuit loop.

The magnitude and phase of the first output signal can be modified via the filter. The adjustment of the directional microphone can therewith be improved.

An advantage of an adaptation with the microphone model in comparison to an adaptation with the filter that can reproduce the arbitrary phase functions is the simplicity of the realization. Additionally, it is fundamentally more advantageous to start from a simplified model concept and to direct the compensation specifically to the model.

DESCRIPTION OF THE PREFERRED EMBODIMENTS

It is a goal of the invention to adapt two or more microphones to one another with regard to their electrical and acoustic behavior. Each microphone can be described in the low-frequency range as a characteristic acoustic high-pass effect having a cut-off frequency at approximately 50 Hz and an electrical high-pass effect having a cut-off frequency approximately 100 Hz. Both the acoustic and the electrical high-pass effects of each of the multiple hearing device microphones are negligibly different from microphone-to-microphone, and the microphones can be adapted to one another in the following manner.

Figure 1:
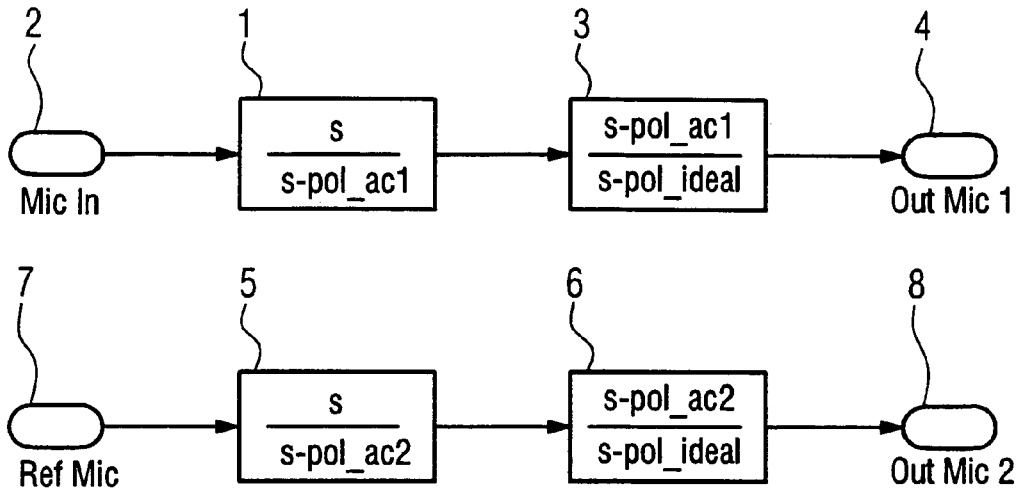
FIG. 1, as described above, is a block diagram for compensation of displacements of high-pass cut-off frequencies according to the prior art.
Figure 2:
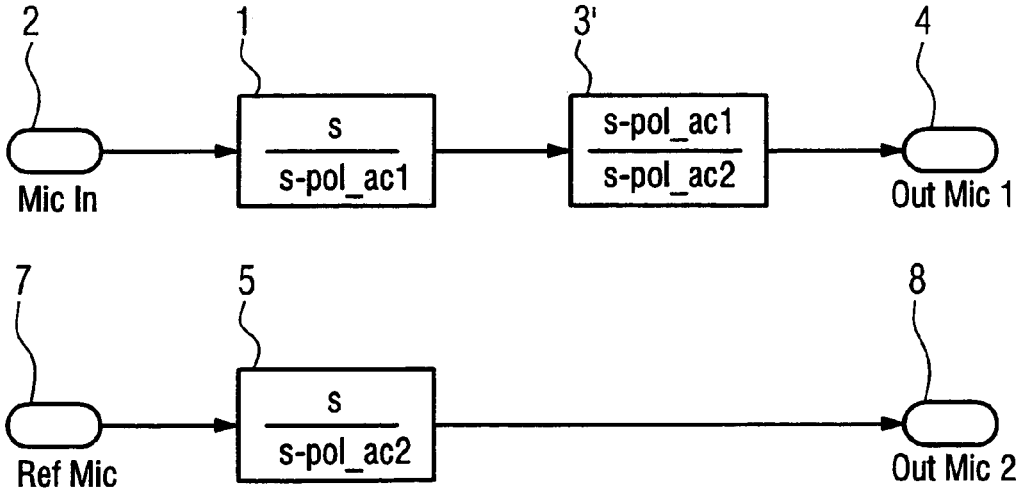
FIG. 2 is a block diagram for compensation of displacements of high-pass cut-off frequencies according to the present invention.

According to the block diagram of FIG. 2, a part of the inventive compensation of the microphone differences ensues, as in the prior art according to FIG. 1, by the microphone input signal 2 is first filtered with an acoustic high-pass effect 1 of the first microphone 1 with the transfer function s/s-pol_ac1. The subsequent compensation filter 3' possesses the transfer function s-pol_ac2/s-pol_ac2. The second microphone path that is shown below in FIG. 2 provided with this transfer function. As in the prior art, the signal 7 of a reference microphone 5 undergoes in this second microphone path a high-pass filter corresponding to the transfer function s/s-pol_ac2. The denominator polynomial of the second acoustic high-pass of the second microphone 5 is used to normalize the compensation filter 3' in the first microphone path. With this normalization, the compensation filter 3' does not have to be normalized to an ideal microphone in order to achieve the first microphone output signal 4. A compensation filter thus can be foregone in the second microphone path in order to achieve the second microphone output signal 8.

The compensation filter 3' has a transfer function with a numerator polynomial s-pol_ac1 and a denominator polynomial s-pol_ac2. Only the numerator is adapted in the simplified compensation, not the denominator and the numerator. The denominator of the of the compensation filter 3' is established for a nominal frequency. In the acoustic case, the nominal frequency is at 50 Hz, and in the electrical case the nominal frequency is at 100 Hz. Only an approximate compensation is possible with this fixed nominal frequency. As mentioned, this approximate compensation is sufficiently good to improve, for example, the directional effect of a directional microphone.

The transformation of such a compensation filter from the analog range into the digital range leads to a simple IIR filter of the first order that can be represented as follows:

$$\frac{p_1(X_p)\cdot z + p_0(X_p)}{z + q_0}$$

The functions $p_1$ and $p_0$, as well as the parameter $q_0$, result from the aforementioned European Patent Application 0982971. The variable z represents the frequency variable of the microphone input signal. The parameter $X_p$ corresponds to a control variable of the compensation filter. The denominator is invariable in this simplified approach.

According to a second embodiment of the present invention, an improved adaptation of the compensation filter results in that the denominator is also variable with regard to its transfer function via a parameter $X_q$, as follows:

$$\frac{p_1(X_p)\cdot z + p_0(X_p)}{z + q_0(X_q)}$$

Figure 3:
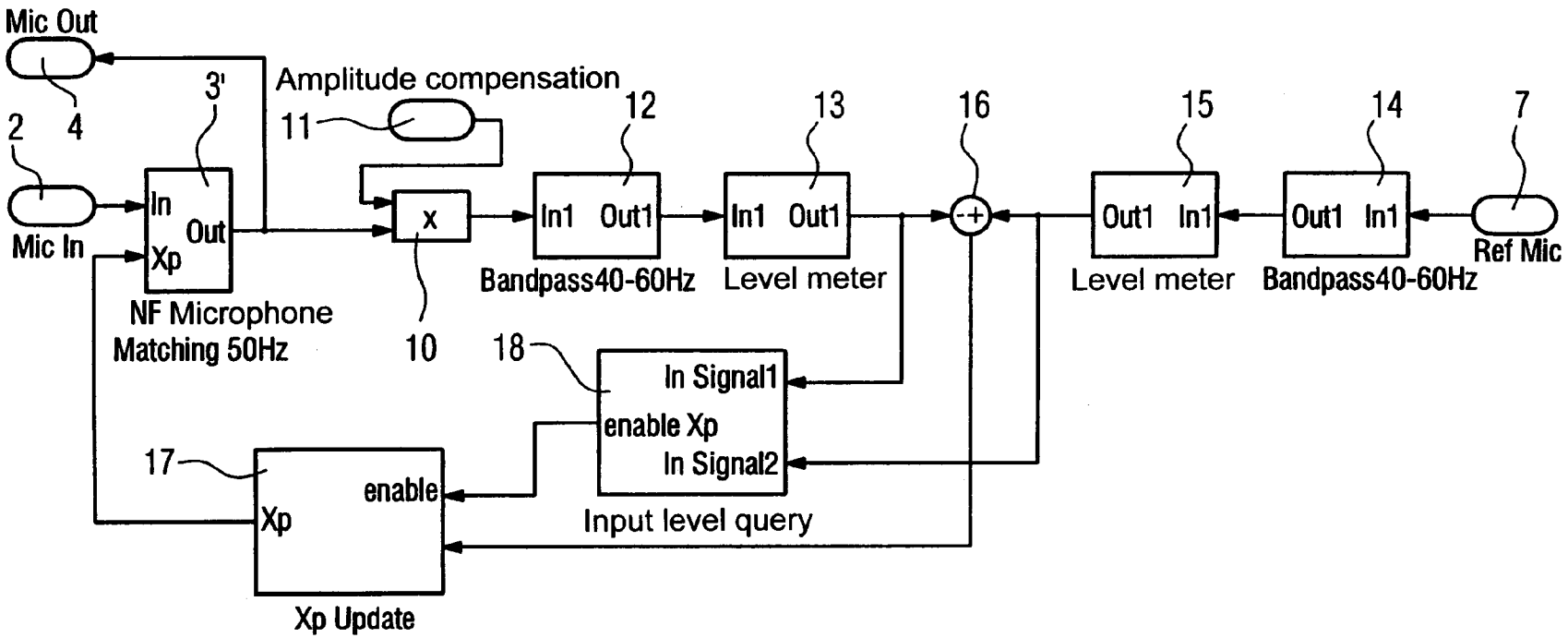
FIG. 3 is an exemplary circuit diagram of a compensation circuit according to a first embodiment of the present invention.

An implementation for adaptation of the high-pass effect of a microphone according to the first embodiment, in which the denominator of the transfer function of the compensation filter is fixed, is shown in FIG. 3 as a block diagram. The input unit forms the compensation filter 3' that was already explained in connection with FIG. 2. Input signal is here also the signal 2 of a first microphone, whereby the reproduction of an acoustic high-pass effect that represents the microphone has been foregone in this representation, in contrast to FIG. 2. The output signal of the compensation filter 3', that implements the low-frequency microphone matching in the present case of the acoustic high-pass filter at 50 Hz, is likewise the signal 4. This is supplied to a multiplication unit in which the signal can be broad-band corrected with a corresponding compensation factor 11 with regard to the amplitude.

In a subsequent bandpass filter 12, a frequency range between 40 and 60 Hz is excised from the output signal of the multiplication unit 10 and supplied to a level meter 13. The level of the frequency range to be analyzed is there determined from the signal of the first microphone 2.

Parallel to this, the output signal (resulting from a second microphone input signal 8) of a second or reference microphone (not shown) likewise undergoes a bandpass filtering. For this, a bandpass filter 14 in turn removes the frequency range between 40 and 60 Hz from the output signal of the microphone and delivers the filtered signal in turn to a level meter 15.

The levels measured by the level meters 13 and 15 are subtracted from one another in a subtraction unit, and the resulting level difference is made available for an update unit for updating the $X_p$ variable. An updating of the $X_p$ value, however, should ensue only when the microphone signals exhibit a suitably high level. For this, the microphone levels are supplied to an input level query unit 18 that generates an enable-$X_p$ signal when both signal levels exceed a certain threshold. Thus it can be prevented that a microphone adaptation ensues in cases in which no acoustic input signals are present, only microphone noise. The enable-$X_p$ signal is therefore further looped to an $X_p$-update unit 17.

The current value $X_p$ in update unit 17 is now supplied to the compensation filter 3' to complete the control loop. The determination of the $X_p$ value, and therewith the adaptation of the microphones to one another, can ensue in the $X_p$-update unit 17 via an (N)LMS algorithm (Normalized Least Mean Square), whereby an "acoustical delay" block is necessary.

Figure 4:
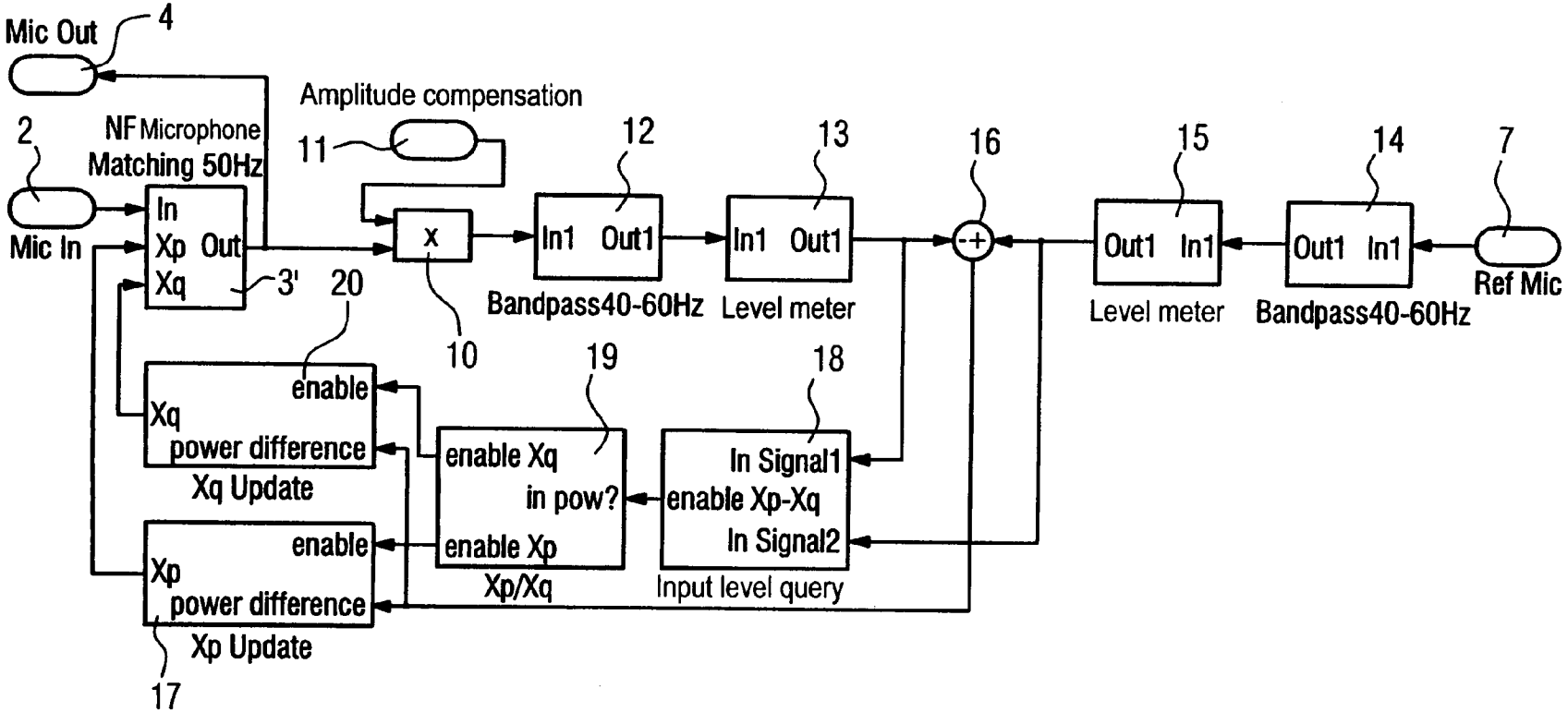
FIG. 4 is an exemplary circuit diagram of a compensation circuit according to a second embodiment of the present invention.

A circuit for a version of an adaptation circuit is shown in FIG. 4. The basic design corresponds to that of FIG. 3, whereby the function blocks corresponding to one another execute essentially the same functions. Only the compensation filter (that is likewise designated with the reference character 3') possesses a further signal input with which the denominator polynomial can be changed via the variable $X_q$.

In order to be able to implement a change of both the numerator polynomial and the denominator polynomial, the output signal of the input level query unit 18 (with which it is determined whether both microphone signals have a sufficiently high level) are forwarded to a switch 19. This switch 19 generates an enable-$X_q$ signal and an enable-$X_p$ signal in a time-variable manner, in the event that it receives an enable-$X_p$-$X_q$ signal from block 18.

In addition to the $X_p$-update unit 17, an $X_q$-update unit 20 to change or update the $X_q$ value is also provided. In the event that the switch 19 delivers an enable-$X_q$ signal, the $X_q$ value is changed corresponding to the level difference from the subtracter 16. When the switch 19 otherwise delivers an enable-$X_p$ signal, the $X_p$ value is changed in the $X_p$-update unit 17 corresponding to the level difference. When the level difference is smaller than 0, the $X_p$ or $X_q$ value is changed in one direction, and when the level difference is greater than 0, the $X_p$ or $X_q$ value is changed in the other direction.

The compensation filter 3' receives the changed or updated $X_p$ or $X_q$ values as control variables. As in the preceding embodiment according to FIG. 3, the different high-pass cut-off frequencies of the microphones signify different averaged output levels of both microphone signals in a narrow frequency range around the cut-off frequencies. This means that the level difference is directly dependent on the difference of the cut-off frequencies. Therefore simply the difference of the levels is formed (power difference) to adapt the cut-off frequencies.

The total range of a directional microphone from the microphone input to the output is in many cases described at low frequencies with further high-pass effects of the first order. In addition to the acoustic high-pass filter effect, the microphone also has an electrical high-pass effect of the first order with a cut-off frequency of approximately 180 Hz. A further high-pass effect results via a coupler capacitor and input resistance of an IC input level.

The adaptive method described above can in principle be adapted to all components high-pass effect.

Although modifications and changes may be suggested by those skilled in the art, it is the intention of the inventors to embody within the patent warranted hereon all changes and modifications as reasonably and properly come within the scope of their contribution to the art.

The invention claimed is:

1. A method for reciprocal adaptation of a plurality of microphones of a hearing device, comprising the steps of:

receiving incoming audio signals respectively with a plurality of microphones, with each microphone generating an output signal dependent on the audio signals received by that microphone, said microphones having respectively different sensitivities such that a difference exists between a first output signal from a first of said plurality of microphones and a second output signal from a second of said plurality of microphones;

measuring a first amplitude of said first output signal in a predetermined frequency range;

measuring a second amplitude of said second output signal in said predetermined frequency range; and reducing said difference by filtering said first output signal dependent on said first amplitude and on said second amplitude in a filter by multiplying filtering said first output signal with a transfer function of said filter having a numerator polynomial and a denominator polynomial, and in a feedback regulation loop containing said filter, varying only said numerator polynomial in said feedback regulation loop to equalize said first and second amplitudes.

2. A method as claimed in claim 1 comprising employing at least one frequency band below 150 Hz as said predetermined frequency range.

3. A method as claimed in claim 1 comprising employing at least one frequency band selected from the group consisting of a frequency band between 40 and 60 Hz and a frequency band between 80 and 120 Hz as said predetermined frequency range.

4. A method as claimed in claim 1 wherein said first output signal has a magnitude and a phase, and comprising filtering said first output signal to modify at least one of said magnitude and said phase.

5. A hearing device comprising a plurality of microphones that receive incoming audio signals, each microphone generating an output signal dependent on the audio signals received by that microphone, said microphones having respectively different sensitivities such that a difference exists between a first output signal from a first of said plurality of microphones and a second output signal from a second of said plurality of microphones;

a first measurement unit that measures a first amplitude of said first output signal in a predetermined frequency range;

a second measurement unit that measures a second amplitude of said second output signal in said predetermined frequency range; and a filter and a feedback regulation loon containing said filter that reduce said difference by filtering said first output signal dependent on said first amplitude and on said second amplitude by multiplying said first output signal with a transfer function of said filter having a numerator polynomial and a denominator polynomial and, in said feedback regulation loop, varying only said numerator polynomial.

6. A device as claimed in claim 5 wherein said first and second measurement units respectively measure said first and second amplitudes in at least one frequency band below 150 Hz as said predetermined frequency range.

7. A device as claimed in claim 5 wherein said first and second measurement units respectively measure said first and second amplitudes in at least one frequency band selected from the group consisting of a frequency band between 40 and 60 Hz and a frequency band between 80 and 120 Hz as said predetermined frequency range.

8. A device as claimed in claim 5 wherein said first output signal has a magnitude and a phase, and wherein said filter filters said first output signal to modify at least one of said magnitude and said phase.

* * * * *